United States Patent [19]

Crudele

[11] Patent Number: 4,545,558

[45] Date of Patent: Oct. 8, 1985

[54] PLATFORM SUSPENDING DAVIT MOUNTING APPARATUS AND METHOD

[75] Inventor: Richard E. Crudele, Farmington Hills, Mich.

[73] Assignee: Powered Platforms Mfg., Livonia, Mich.

[21] Appl. No.: 547,370

[22] Filed: Oct. 31, 1983

[51] Int. Cl.[4] ..... F16M 13/00

[52] U.S. Cl. ..... 248/544; 52/116; 182/142

[58] Field of Search ..... 248/544, 235, 239, 240.1, 248/240.2; 182/142, 45; 52/116, 117, 118, 119, 120; 114/368, 369, 370, 371, 372, 373

[56] References Cited

U.S. PATENT DOCUMENTS 4,355,699 10/1982 Smith ..... 182/142

4,454,928 6/1984 Marteau et al. ..... 182/142

*Primary Examiner*—Ramon S. Britts

*Assistant Examiner*—Ramon O. Ramirez

*Attorney, Agent, or Firm*—Harness, Dickey & Pierce

[57] ABSTRACT

A mounting socket and method for removably attaching a platform supporting davit to a rooftop. The mounting socket includes a folding handle and wheels permitting easy transportation from a storage location to a position near a compatible building supported mounting pedestal. A pair of fixed hooks formed by the socket engage a pair of holes formed by the platform. The socket includes a hollow cavity adapted to receive the davit. As the socket is rotated into vertical position, a locking clamp having movable hooks engages the platform and a secondary locking lever acts to ensure that the locking clamp remains in a locked position on the pedestal. A davit locking pawl prevents inadvertent removal of the davit from the socket when the socket is in the vertical position.

9 Claims, 5 Drawing Figures

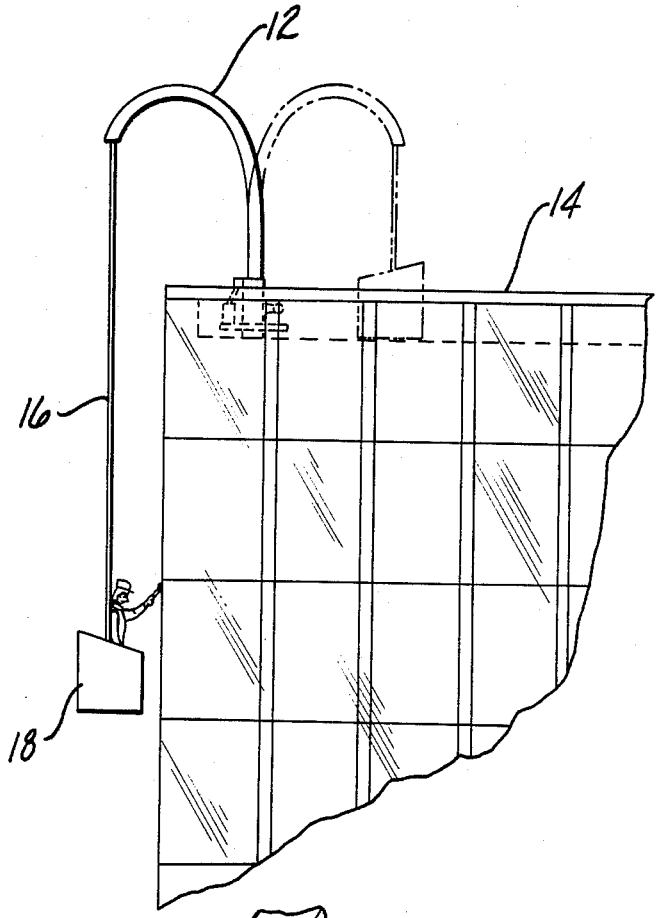
Fig-1
Fig-2
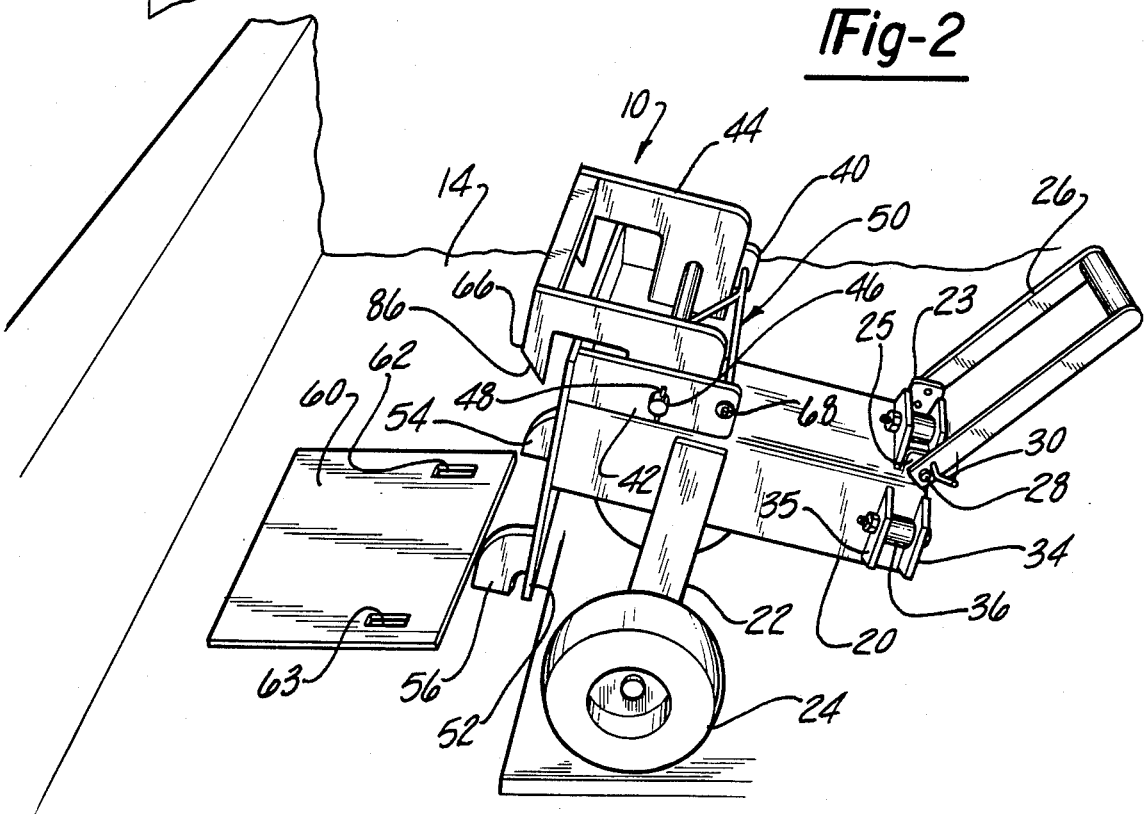

PLATFORM SUSPENDING DAVIT MOUNTING APPARATUS AND METHOD

This invention relates to a davit mounting and supporting system and particularly to a removable mounting socket which supports davits from which a platform useful for window washing and building maintenance is suspended.

Roof mounted platform suspension systems are often used as means of providing access by workmen to the sides of buildings. Typically, davits in the forms of bent arms are used which are removably mounted to sockets on the building roof. Particuarly desirable for such systems are devices which do not employ loose parts for installation of the davits. Further, positive locking systems are needed in order to provide injury protection for the workers during both installation and use. Ease of operation is also a desirable characteristic.

SUMMARY OF THE INVENTION

The platform suspending davit mounting apparatus and method of the present invention achieves the above mentioned desirable characteristics by providing a portable davit mounting socket having wheels and a handle which enable it to be moved in wheelbarrel like fashion from a storage area into position onto a building roof supported mounting pedestal. The socket engages the building supported pedestal by a pair of fixed hooks. Once the hooks engage the pedestal, the mounting socket is partially rotated toward an intermediate position at which time davits are installed within the socket. Upon installation of the davit, the socket is rotated into an erect position whereby movable platform engaging hooks engage the pedestal. This mounting system employs a gravity actuated lock used with a secondary latching system which together provide a positive lock preventing accidental disengagement of the movable hooks. An additional gravity sensitive locking pawl is employed which prevents the davits from being removed from the socket when the socket is in an erect locked position. The apparatus and method described herein provides a davit installation system which does not employe loose parts, having a positive locking system, and which is further very simple to operate.

Additional benefits and advantages of the present invention will become apparent to those skilled in the art to which this invention relates upon a reading of the described preferred embodiments of this invention taken in conjunction with the accompanying drawings.

BRIEF DESCRIPTION OF THE DRAWINGS

FIG. 1 is a pictorial view of a roof supported davit supporting a platform over the side of a building. The davits are shown by phantom lines in an initial position where the platform is attached and in a final position where the davits are swung out whereby the platform is extended over the edge of the building.

FIG. 2 is a pictorial view of the diavit mounting socket according to this invention positioned near a mounting pedestal fixed to the roof surface of a building.

DETAILED DESCRIPTION OF THE INVENTION

Figure 3:
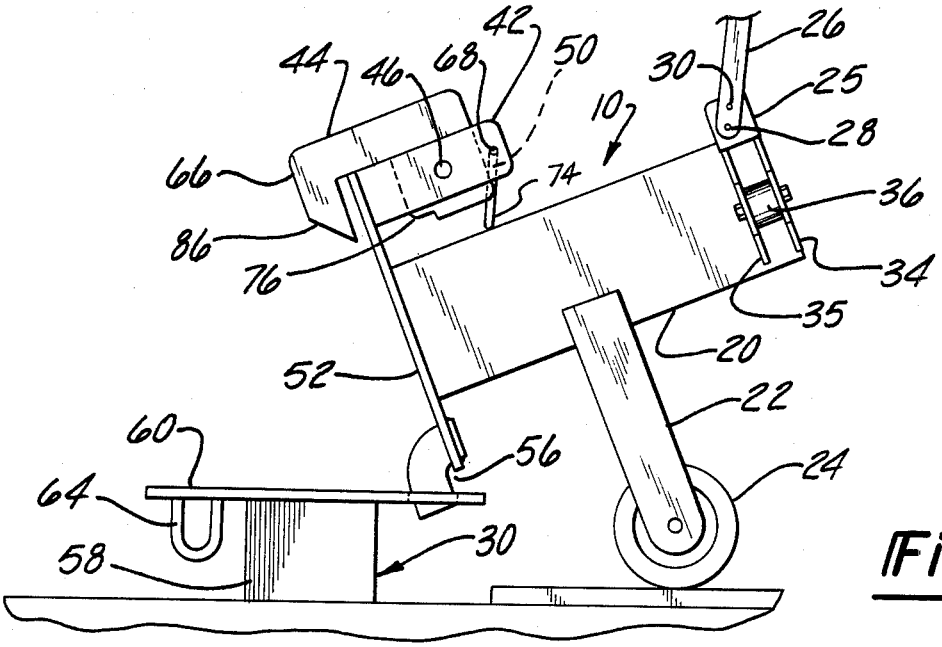
FIG. 3 is a side elevational view of the davit supporting socket according to this invention engaging the roof supported mounting pedestal in an initial installation position.

A davit mounting socket in accordance with the teachings of this invention is best described with reference to FIGS. 2 through 5 and is generally designated by reference character 10. With reference to FIG. 1 a davit platform suspending system is shown in use. Davit 12 is shown mounted to the roof of building 14 by davit mounting socket 10. Suspension line 16 is connected between davit 12 and platform 18. Davit 12 is shown in two positions, the first position shown in phantom lines depicts the davit position in which platform 18 can be raised off the roof by the operator. After platform 18 is raised off the roof, the davit is caused to swing such that its end extends over the side of building 14 thereby permitting the platform to be lowered to the desired vertical position. The platform is caused to raise and lower by the operator by winches installed within the platform. Thus, the operator is able to raise and lower himself along the building at a given position in order to access the building windows for cleaning and to perform other maintenance functions.

Figure 4:
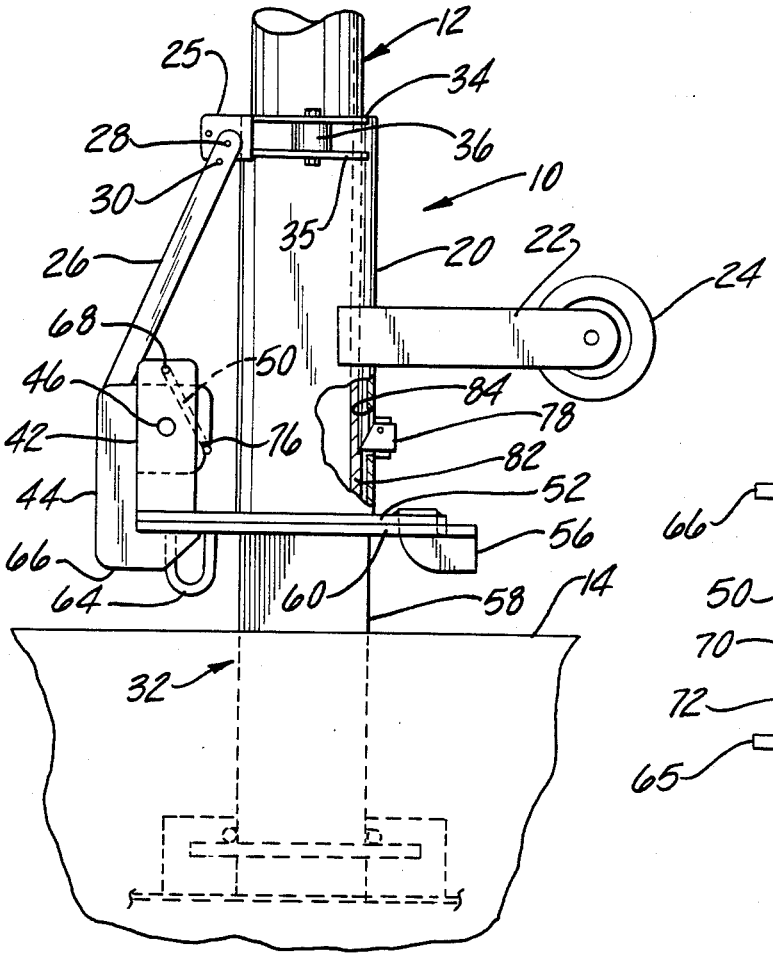
FIG. 4 is another view of the davit mounting socket according to this invention installed in a locked erect position onto the roof supported mounting pedestal.
Figure 5:
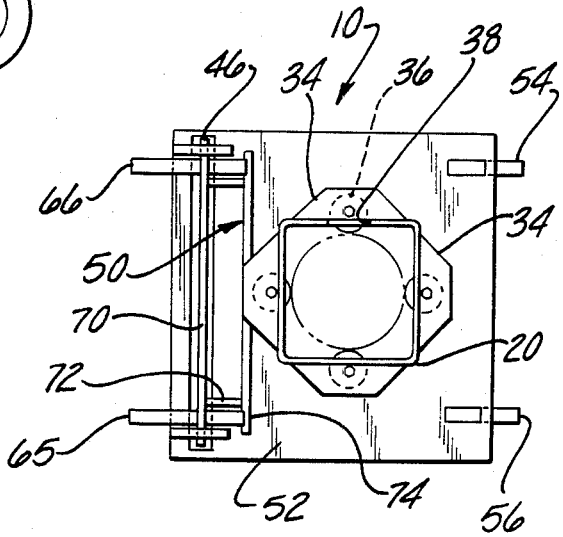
FIG. 5 is a top view of the davit supporting socket according to this invention.

With particular reference to FIG. 2, the davit mounting socket according to this invention is shown in detail. Socket 10 includes housing 20 which is preferably formed of hollow extruded or fabricated metal stock shown by the Figure as having a box shaped cross section. Fixed to the sides of housing 20 are legs 21 and 22 to which wheels 24 are rotatably mounted. Folding handle 26 is hinged to flanges 23 and 25 formed by housing 20 and permit socket 10 to be transported in wheelbarrel-like fashion. Folding handle 26 is hinged to housing flanges 23 and 25 by pin 28. Locking pin 30 positions handle 26 at a desired angular location, yet may be removed in order to allow the handle to be folded against the side of housing 20. Thus, davit mounting socket 10 may be easily moved from a storage location atop building 14 into position near pedestal 32 which is permanently mounted to the building. Socket 10 further forms bearing mounting flanges 34 and 35 which support bearing assemblies 36. Bearing assemblies 36 act to rotatably support davit 12 such that the davit may be rotated. Bearing assemblies 36 are mounted in registry with housing appertures 38 which permits the bearing assembly to contact davit 12 as best shown by FIG. 5. Mounting socket 10 further forms locking clamp mounting flanges 40 and 42. Flanges 40 and 42 rotatably support locking clamp member 44 about pin 46. Pin 46 is retained in position by a cotter pin as shown by FIG. 2 or may be fastened by any known means. Locking clamp flanges 40 and 42 further provide a mounting support for secondary locking lever 50. Mounted to the end of housing 20 opposite that supporting folding handle 26 is plate 52. From plate 52 extend fixed hooks 54 and 56. Building supported pedestal 32 includes upright post member 58 which is embedded within the building roof as best shown in FIG. 4. Pedestal 32 also includes mounting platform 60 which includes two spaced slots 62 and 63 conformed and spaced to receive hooks 54 and 56. Pedestal 32 is permanently attached to the building and there would typically be a plurality of such pedestals at various locations along the periphery of building 14. Mounting platform 60 further provides a mounting location for u-bolt 64 best shown in FIG. 3 which provides an anchorage for safety lines which may be attached to the operator.

With reference to FIG. 4, locking clamp 44 is configured such that its center of mass lies to the left of the pivot established by pin 46. Therefore, in the position shown in FIG. 4, locking clamp 44 is biased by gravity to rotate in a counterclockwise direction thus retaining the hook portions 65 and 66 of locking clamp 44 in engagement with platform 60. As a secondary locking means, locking lever 50 is provided having a pivot 68 formed by flanges 40 and 42. Secondary locking lever 50 has a first member 70 which spans between locking clamp flanges 40 and 42 forming extending arms 72 and a notch engaging post 74. The orientation of locking lever pivot 68 within flanges 40 and 42 is such that it is biased by gravity to rotate in a clockwise direction when socket 10 is in an erect vertical position as shown in FIG. 4. In the position shown, notch engaging post 74 engages notch 76 formed by locking clamp 44. Therefore, a positive means of retaining locking clamp 44 in an engaged position with platform 60 is provided.

In addition to means for locking mounting socket 10 into engagement with platform 60, means are provided to lock davit 12 within socket 10. A davit locking pawl 78 is provided which is rotatably attached to housing 20. This locking pawl engages a radially extended flange 82 formed near the base of davit member 12 as shown in FIG. 4. Pawl 78 is biased in an engaging position with flange 82 through aperture 84 such that when socket 10 is in an erect vertical position locking pawl 78 acts to prevent removal of davit 12 from mounting socket 10. Such biasing is achieved by forming pawl 78 such that its center of gravity is to the right of its pivot, with reference to FIG. 4 such that the pawl is biased to tend to rotate clockwise. Pawl 78 moves out of engagement with flange 82 when socket 10 is in an intermediate angular position with respect to mounting pedestal 37 thereby permitting unrestricted installation and removal of davit 12.

In operation, mounting socket 10 is best explained with reference to FIGS. 2 through 4. Mounting socket 10 is first positioned adjacent to mounting pedestal 32 as shown in FIG. 2. In this position, folding handle 26 is positioned to provide a means for transportating socket 10. Davit 12 is connected via suspension line 16 to platform 18. Mounting socket 10 is rotated in a counterclockwise direction as shown in FIG. 3 with fixed hooks 54 and 56 in registry with slots 62 and 63 formed by mounting platform 60, also shown by FIG. 3. In this position, davit member 12 is inserted within housing 20. Finally, mounting socket 10 is locked into engagement with mounting platform 60 by continuing to rotate the socket in a counterclockwise direction to a final erect position as shown by FIG. 4. Just prior to reaching the position shown in FIG. 4, an operator must insure that secondary locking lever 50 is not engaging notch 76 so that locking clamp 44 may be rotated clockwise through the interaction between mounting platform 60 and ramped surface 86. Finally, when the socket is in the erect position as explained earlier, locking clamp 44 rotates without external actuation into a locked position. In addition, secondary locking lever 50 falls into engagement notch 76 whereby the socket is firmly mounted to platform 60. In this position, pawl 78 engages davit 12 as explained above thus locking it in position. By causing platform 18 to be raised slightly it may be pushed outwardly with respect to the building causing davit 12 to rotate to the position shown in FIG. 1 such that platform 18 may be raised and lowered as shown.

While preferred embodiments of the invention have been described herein, it will be appreciated that various modifications and changes may be made without departing from the spirit and scope of the appended claims.

I claim:

1. A socket removably mounted to a pedestal for mounting a davit useful for suspending a platform over the side of a building comprising:

a housing having a first and second end adapted to slidably receive said davit through said first end;

a plate affixed to said second housing end;

a pair of pedestal engaging hooks affixed to said plate; and a locking clamp for releasably connecting said socket to said pedestal.

2. A socket removably mounted to a pedestal for mounting a davit useful for suspending a platform over the side of a building comprising:

a housing having a first and second end adapted to slidably receive said davit through said first end;

a plate affixed to said second housing end;

a pair of pedestal engaging hooks affixed to said plate; and a locking clamp affixed to said housing for releasably connecting said socket to said pedestal, said locking clamp movable between a pedestal engaging position and a pedestal disengaging position.

3. The socket according to claim 2 whereby said locking clamp is biased by its weight to said pedestal engaging position.

4. The socket according to claim 2 further comprising a secondary locking lever which locks said locking lever in said pedestal engaging position.

5. The socket according to claim 2 further comprising a davit locking pawl engaging said davit.

6. A davit mounting system according to claim 2 further comprising a pair of wheels affixed to said housing and a handle attached to said housing whereby said housing may be easily transported.

7. A socket removably mounted to a pedestal for mounting a davit useful for suspending a platform over the side of a building comprising:

an elongated hollow housing having a first and second end, a plate enclosing said first housing end, a plurality of bearing assemblies affixed to said housing adjacent said second housing end, such that when said davit is inserted within said housing through said second end said davit may be rotated within said housing, fixed hooks affixed to said plate, and engageable with said pedestal and movable hooks rotatably fixed to said housing and secondary locking means characterized in that said movable hooks and said secondary locking means are biased by gravity into a pedestal engaging position when said socket is moved into an erect position.

8. The socket according to claim 7 further comprising means for locking said davit in position within said housing.

9. A method for installing a davit to a rooftop mounting system using a portable mounting socket comprising the steps of:

providing a socket having a pair of platform engaging hooks and a rotatable locking clamp, moving said socket into position near said platform, positioning said platform engaging hooks in registry with a pair of holes formed by said pedestal, inserting said davit within said mounting socket, and rotating said socket in an erect vertical position thereby causing said locking claim to engage said platform.

* * * * *